US005100145A

United States Patent [19]

Kim

[11] Patent Number: 5,100,145

[45] Date of Patent: Mar. 31, 1992

[54] PUTTING GREEN WITH ADJUSTABLE TOPOGRAPHY AND MULTI-BALL RETURN

[76] Inventor: Samuel Kim, 3820 Charlemagne Dr., Hoffman Estates, Ill. 60195

[21] Appl. No.: 578,568

[22] Filed: Sep. 6, 1990

Related U.S. Application Data

[63] Continuation-in-part of Ser. No. 485,296, Feb. 26, 1990.

[51] Int. Cl.[5] ..... A63B 67/02; A63B 69/36

[52] U.S. Cl. ..... 273/176 H; 273/176 E

[58] Field of Search ..... 273/176 E, 176 H

[56] References Cited

U.S. PATENT DOCUMENTS

| | | | |
|---|---|---|---|
| 1,662,864 | 3/1928 | Petersen | 273/176 H |
| 1,761,039 | 6/1930 | Hazeltine | 273/176 H |
| 3,366,388 | 1/1968 | Del Raso . | |
| 3,508,756 | 4/1970 | Bedford | 273/176 H |
| 3,601,407 | 8/1971 | Lorrance . | |
| 3,658,343 | 4/1972 | Rogers et al. . | |
| 3,690,673 | 9/1972 | Occhipinti | 273/176 H |
| 3,727,917 | 4/1973 | MacLean . | |
| 3,762,718 | 10/1973 | Culley . | |
| 3,831,949 | 8/1974 | Henning . | |
| 3,871,650 | 3/1975 | Casey | 273/176 H |
| 4,222,568 | 9/1980 | Russo . | |
| 4,240,637 | 12/1980 | Cross et al. . | |
| 4,247,112 | 1/1981 | Del Raso . | |
| 4,611,809 | 9/1986 | Gettlefinger . | |
| 4,790,538 | 12/1988 | Gettlefinger . | |
| 4,978,127 | 12/1990 | Juel | 273/176 H |

*Primary Examiner*—William H. Grieb

*Attorney, Agent, or Firm*—Laff, Whitesel, Conte & Saret

[57] ABSTRACT

A golf putting assembly comprising a playing surface having a target hole, elevation means for adjusting the topography of the playing surface, and ball return means that elevate an entire section at the end of the playing surface nearest the target hole such that an incline is created, the incline causing any balls thereon to move away from the incline.

10 Claims, 9 Drawing Sheets

| COMBINATION NUMBER | ACTUATOR POSITIONS 374 | 378 | 382 | 386 | 390 |
|---|---|---|---|---|---|
| 1 | N | N | N | N | N |
| 2 | E | N | N | N | N |
| 3 | N | E | N | N | N |
| 4 | E | E | N | N | N |
| 5 | N | N | E | N | N |
| 6 | N | N | N | E | N |
| 7 | N | N | E | E | N |
| 8 | E | N | E | N | N |
| 9 | N | E | E | N | N |
| 10 | E | E | E | N | N |
| 11 | E | N | N | E | N |
| 12 | N | E | N | E | N |
| 13 | E | E | N | E | N |
| 14 | E | N | E | E | N |
| 15 | N | E | E | E | N |
| 16 | E | E | E | E | N |
| 17 | E | E | N | N | E |
| 18 | E | N | N | N | E |
| 19 | N | N | N | N | E |

FIG. 22

PUTTING GREEN WITH ADJUSTABLE TOPOGRAPHY AND MULTI-BALL RETURN

This is a continuation-in-part of Ser. No. 7/485,296, filed Feb. 26, 1990 in the name of Samuel Kim covering "Putting Green with Adjustable Topography and Multi-Ball Return".

FIELD OF THE INVENTION

This invention relates to a putting green for golfers. More particularly, this invention relates to a putting green assembly for golfers that includes an adjustable topography and multi-ball return mechanism.

BACKGROUND OF THE INVENTION

A variety of putting greens for golfers are known. These putting greens may be portable, as, for example, the greens often found in homes or offices, or these putting greens may be stationary or permanently fixed to an area, such as the greens found in amusement parks or game rooms. Regardless of whether these prior art putting greens are portable or stationary, they basically are similar in their structure and mode of operation. For example, most existing portable and stationary greens have stationary slopes. Thus, the area or slope surrounding the ball cup always remains constant and may not be adjusted for slope variation. Usually, the slope is upward toward the cup, to accommodate the depth of the cup and to avoid digging a hole in the underlying surface. Furthermore, most existing portable and stationary greens usually require the golfer to retrieve each putted ball from the cup or the area surrounding the cup by approaching the cup and stooping to pick it up. While some of the existing greens include a ball retrieval mechanism, these mechanisms usually involve systems which only remove the ball found in the cup, and not balls in the area surrounding the cup. Furthermore, these mechanisms generally only return one ball at a time, so that a golfer must wait for a ball in the cup to be returned before hitting another ball. In some cases, these ball-in-the-cup retrieval mechanisms do not operate to return the putted ball to the golfer, but instead, the balls are returned to a holding box as a theft preventative measure. Such holding boxes are typically found in amusement parks or game rooms.

Existing games do not keep the golfer's score or distinguish between a successful or unsuccessful initial putt, other than that the ball may be returned with a successful putt. If the first putt does not land in the cup, the golfer usually must walk to the ball and putt again. In an arcade or game room, this substantially reduces the pace of the game and limits the number of potential players within a given time span.

Thus, while the existing portable and stationary putting greens offer the golfer the basic essentials—a green with a single slope and a cup for the ball—they are extremely limited in their structure and operation.

Accordingly, an object of the present invention is to provide a putting green assembly having an adjustable slope of multiple variations.

Another object of the present invention is to provide a putting green assembly having a multi-ball return mechanism.

Another object of the present invention is to provide a putting green assembly in which the area of the green surrounding the cup need not have an upward slope to accommodate the depth of the cup.

Yet another object is to provide a putting green assembly which senses that a ball has been putted and is on the playfield, off the playfield, or in the cup, and assigns a different score for each position.

Another object of the present invention is to provide a putting green assembly that may include an extension mat for chipping.

Another object of the present invention is to provide a putting green assembly which may be portable or stationary.

A further object of the present invention is to provide a putting green assembly which may be used indoors or outdoors.

SUMMARY OF THE INVENTION

The present invention accomplishes the foregoing objects by providing a putting green assembly comprising, in part, an adjustable slope and multi-ball return mechanism. In a first and second embodiment, the putting green assembly comprises a combination slope elevation mechanism and a multi-ball return mechanism which is operated manually. This combination slope elevation and multi-ball return mechanism in both embodiments is elevated above and straddles the green at that end of the green where the cup is located. In both embodiments, the combination mechanism includes a plurality of rope members or cords that extend to and are attached to the green at various locations. In the first embodiment, the rope members or cords are attached to the exterior of the combination mechanism by a plurality of rings. In the second and third embodiments, the rope members or cords are attached to the interior of the combination mechanism by a detent mechanism.

The slope of the green in all of the above embodiments is changed by adjusting the cords or other rope material at certain points. The balls lying around or inside the cup are all returned simultaneously in both embodiments by pulling a specific cord or rope on the combination mechanism.

A fourth embodiment of the putting green assembly according to the present invention provides automated playing surface elevation, ball return, and scoring and is therefore more suitable for use in sophisticated applications including, for example, a public game arcade or the home or office of an avid golfer.

The above, as well as other objects and advantages of the invention, will become apparent from the following detailed description of the preferred embodiments, reference being made to the accompanying drawings.

BRIEF DESCRIPTION OF THE DRAWINGS

FIG. 22 is a table illustrating the various possible positions of the actuators underlying the playing surface.

DETAILED DESCRIPTION OF THE INVENTION

Figure 1:
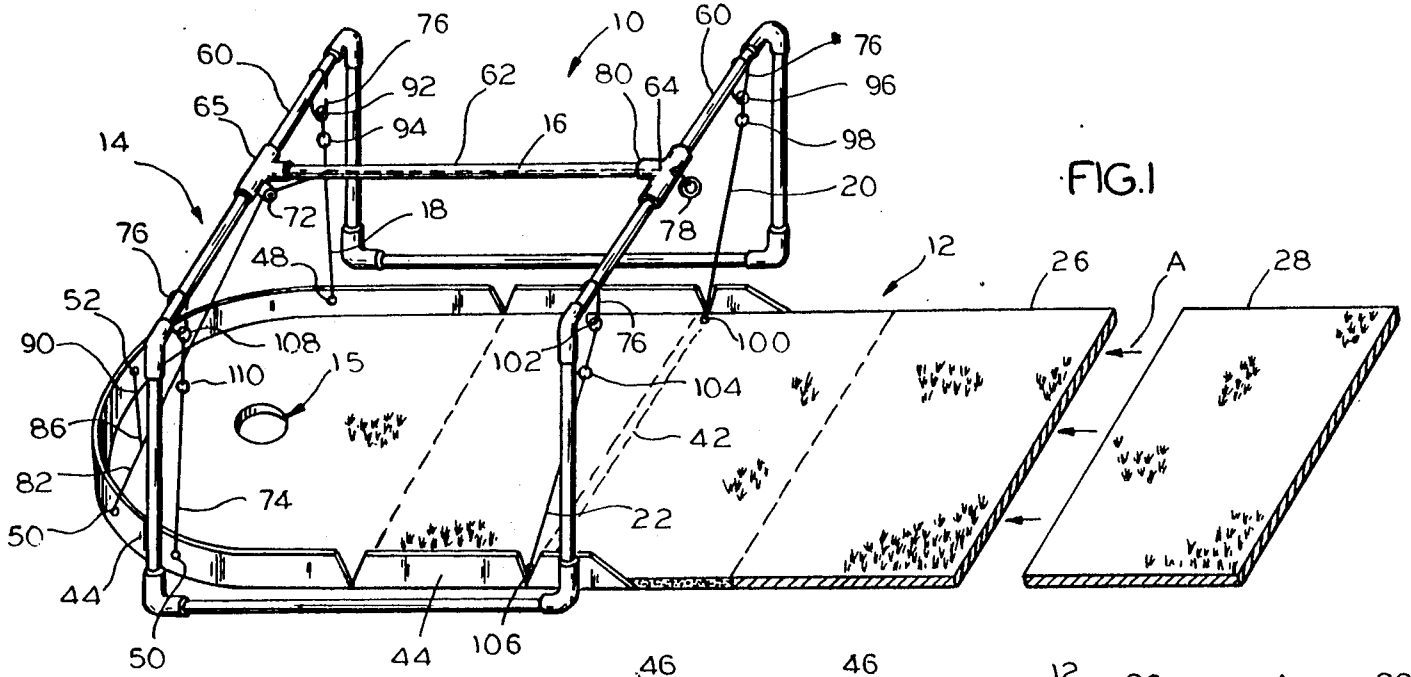
FIG. 1 is a perspective view of a first embodiment of the inventive putting green assembly.

Referring first to the first embodiment shown in FIGS. 1–9, a putting green assembly is generally denoted by the numeral 10, and includes, in part, an elongated putting green or playing surface 12, a combination slope-elevation and multi-ball retrieval mechanism 14 and ball cup 15. As used herein, the term "multi-ball retrieval mechanism" means a mechanism capable of returning multiple balls simultaneously. Cords or rope members 16, 18, 20, 22 and 24 extend from the exterior of mechanism 14 to playing surface 12 and enable a player to manually adjust the elevation and topography of playing surface 12.

Figure 2:
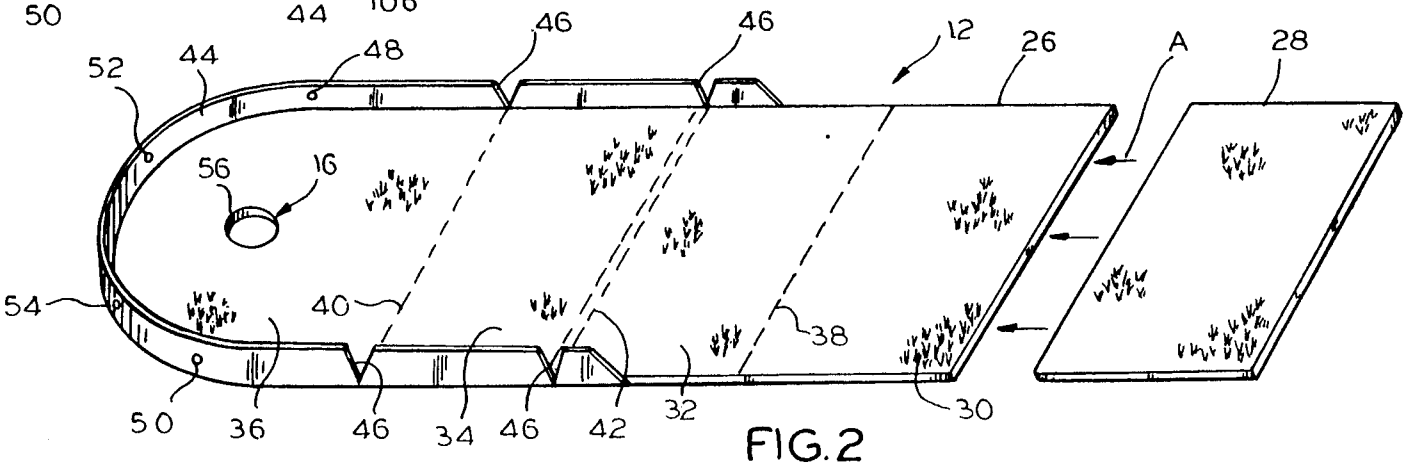
FIG. 2 is a perspective view of the playing surface of the inventive putting green assembly of FIG. 1.

Referring to FIG. 2, playing surface 12 generally comprises two main sections 26 and 28. Section 26 is approximately nine feet in length and three feet in width. Section 28 is approximately three feet in length and two feet in width. Both section 26 and 28 are approximately ¾" to 1 inch in thickness which thickness comprises a backing material covered by an artificial grass carpet. These dimensions have been found suitable, but other dimensions may be equally suitable.

Section 26 includes four foldable subsections 30, 32, 34 and 36. Subsection 30 and subsection 32 are separated by a first perforation 38 which extends across the width of playing surface 12. Subsection 34 and subsection 36 are separated by a second perforation 40 which also extends across the width of playing surface 12. Subsection 32 and subsection 34 are separated by a metal plate strip 42, which will be discussed in greater detail later.

Section 26 further includes a plastic fence or ridge 44 which extends upwardly a distance of two to four inches and partially around the perimeter of section 26. Ridge 44 includes a plurality of breaks 46 which are located at each end of second perforation 40 and at the ends of metal plate strip 42. Breaks 46 allow for subsections 32, 34 and 36 to hingedly move along the perforations relative to each other. Ridge 44 further includes holes 48, 50, 52 and 54.

Section 2 also includes ball cup 15 which is located in subsection 36.

Section 28 may be attached to section 26 when needed, as indicated by the arrows A in FIGS. 1 and 2, and serves as an extension or chipping mat.

Subsections 32, 34 and 36 include a flexible sponge backing beneath the overlying artificial grass carpet. Subsection 30 of section 26 and section 28 each include a hard styrofoam backing beneath the overlying artificial grass carpet.

Figure 3:
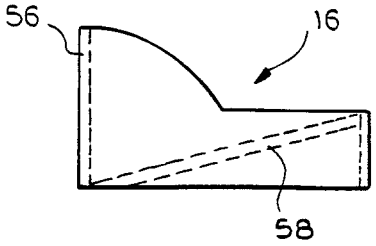
FIG. 3 is a side view of the ball cup illustrated in FIG. 1.

Ball cup 15, as illustrated in FIGS. 1–3, is circular and has approximately a 4 ⅛ inch diameter. Ball cup 15 includes a rim 56 which extends around approximately one-half of the circumference of cup 15, and preferably around that portion of the cup rim most distant from the golfer. Rim 56 extends above the surface of subsection 36 a distance of approximately one inch. The bottom 58 of cup 15 is inclined, with its lowest point intersecting that portion of cup 15 which is adjacent to rim 56 (i.e., the bottom inclines downwardly away from the golfer). Rim 56, in conjunction with the inclined bottom 58 of cup 15, effectively retains a ball which enters the cup.

Figure 4:
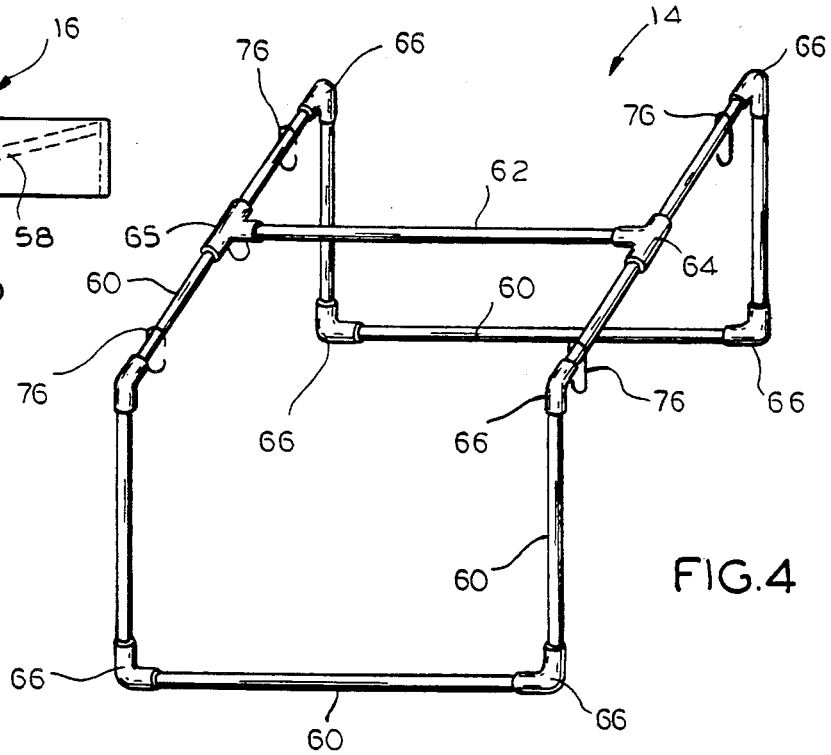
FIG. 4 is a perspective view of the combination slope-elevation and multi-ball retrieval mechanism of the inventive putting green assembly of FIG. 1.
Figure 5:
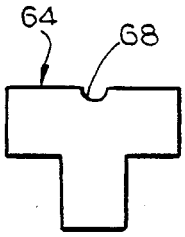
FIG. 5 is a plan view of a T-joint used to secure the piping of the combination slope-elevation and multi-ball retrieval mechanism of FIG. 1.
Figure 6:
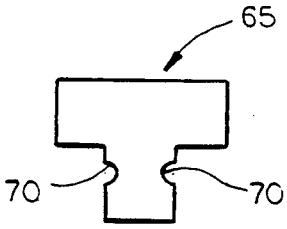
FIG. 6 is a plan view of an elbow joint used to secure the piping of the combination slope-elevation and multi-ball retrieval mechanism of FIG. 1.
Figure 7:
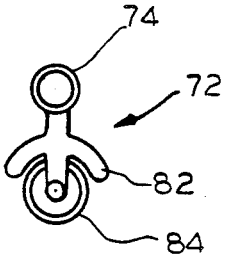
FIG. 7 is a plan view of a roller which is attached to the T-joint illustrated in FIG. 6.
Figure 8:
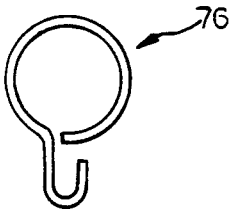
FIG. 8 is a plan view of an o-ring with hooked projection used to adjust the elevation of the putting green assembly shown in FIG. 1.
Figure 9:
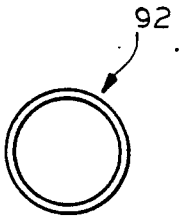
FIG. 9 is a plan view of an o-ring used to adjust the elevation of the putting green assembly of FIG. 1.

Referring to FIG. 4, slope elevation and multi-ball retrieval mechanism 14 generally comprises a plurality of segments or pipes 60, 62, such as poly-vinyl chloride (PVC) piping, connected by various connectors, as for example, T-joints 64, 65 and elbow joints 66. Both T-joints 64 and 65 include openings, 68 and 70, respectively. T-joint 65 further includes a roller 72 (see FIG. 7) which is attached to T-joint 65 through openings 70 by ring 74.

Mechanism 14 of the first embodiment further includes a plurality of o-rings with hooked projections 76 (see FIGS. 4 and 8) which are located on upper pipes 60. These hooked rings 76 will be described in more detail later.

As previously mentioned and as shown in FIG. 1, mechanism 14 is positioned above cup 15 of subsection 36 of section 26. Mechanism 14 is attached to section 26 at numerous locations by cord members 16, 18, 20, 22 and 24.

Cord member 16 is secured to mechanism 14 at T-joint 64, as shown in FIG. 1. A first ring 78 is attached to the one end of cord member 16. Cord member 16 passes into T-joint 64 through opening 68 (see FIG. 5) and then passes out of T-joint 64 at opening 80. Cord member 16 extends in parallel relationship to pipe 62 until it reaches roller 72, whereupon cord member 16 is threaded between roller shield 82 and wheel 84 (see FIG. 7). Cord member 16 extends away from roller 72 whereupon it splits at point 86 and forms a forked section made up of segments 82 and 90. Segments 82 and 90 extend through openings 50 and 52 of ridge 44.

Cord members 18, 20, 22 and 24 each extend downwardly from pipe 60 to section 26 of playing surface 12. Cord member 18 includes a first o-ring 92 at its one end which is attached to pipe 60 at hooked ring 76. Cord member 18 includes a second o-ring 94 which is positioned immediately below first o-ring 92 (see FIG. 9). Cord member 18 extends downwardly whereupon it attaches to ridge 44 through opening 48.

Cord members 20, 22 and 24 are attached in the same manner as cord member 18. Cord member 20 includes a first o-ring 96 at its one end which is attached to pipe 60 at hooked ring 76. Cord member 20 includes a second o-ring 98 below the first o-ring 96. Cord member 20 is attached to metal plate strip 92 through an opening 100.

Cord member 22 has a first o-ring 102 which is attached to hooked ring 76. A second o-ring is positioned immediately below. Cord member 22 is attached to metal strip 42 through an opening 106.

Cord member 24 has first o-ring 108 which is attached to hooked ring 76. A second o-ring 110 is positioned immediately below. Cord member 24 is attached to ridge 44 through opening 50.

The elevation and slope adjustment of playing surface 12 is effectuated by adjusting the length of cord members 18, 20, 22 and 24, which is accomplished by hooking either the first o-ring or the second o-ring of any of the cord members onto hooked ring 76. For example, one of the numerous slopes may be formed by attaching cord member 18 to hooked ring 76 by second o-ring 94, and then attaching cord members 20, 22 and 24 to hooked ring 76 by first o-ring 96, 102 and 108, respectively. Then, to create a different slope from the above slope configuration, one may simply place second o-ring 110 of cord member 24 onto hooked ring 76. The cord members may be adjusted in this manner to create sixteen different slopes for playing surface 12. The first and second perforations, 38 and 40, respectively, and metal strips 42, allow the topography of playing surface 26 to be changed by cord members 20 and 22.

To retrieve a ball from ball cup 15 or from the area surrounding cup 15, a golfer simply pulls ring 78. As previously mentioned, ring 78 is attached to cord member 16 which is in turn attached to ridge 44 of section 26. Thus, when ring 78 is pulled, section 26 is folded slightly along second perforation 40 and metal strip 42 and then moves upwardly. The incline created by pulling ring 78 causes any balls to roll under the force of gravity towards subsection 30 at the other putting end of playing mat 26. Since cup 15 includes a sloped bottom 58, any ball inside of cup 15 also will easily roll out once playing mat 12 is inclined. After the balls have been cleared from that portion of section 26 under retrieval mechanism 14, ring 78 is released by the golfer to lower section 26 to its previously selected elevation.

Referring to FIGS. 10–13, a second embodiment is shown for slope elevation and multi-ball retrieval mechanism 14' which is similar in structure to that of the first embodiment shown in FIGS. 1 and 4, except that cord members 16', 18', 20', 22' and 24' of the second embodiment extend through the interior of and in parallel relation to a plurality of segments or pipes 60', 62' which comprises the structure of mechanism 14'. The playing surface 12' and ball cup 15' of the second embodiment are the same as in the first embodiment. This embodiment conceals the cord members and may be more aesthetically pleasing.

Mechanism 14' also includes a plurality of segments or pipes 60', 62' similar to those illustrated in the first embodiment, except that they have a hollow interior for reasons described hereinafter. Mechanism 14' further includes a detent mechanism 520 which is located on each of upper pipes 60'.

Figure 12:
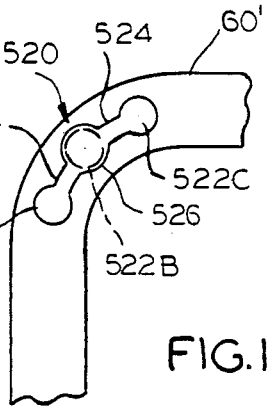
FIG. 12 is a fragmentary side view of the detent mechanism illustrated in FIG. 11.
Figure 13:
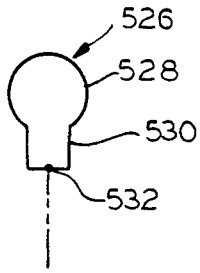
FIG. 13 is a side view of the protuberance that slides within the detent mechanism illustrated in FIG. 12.
Figure 14:
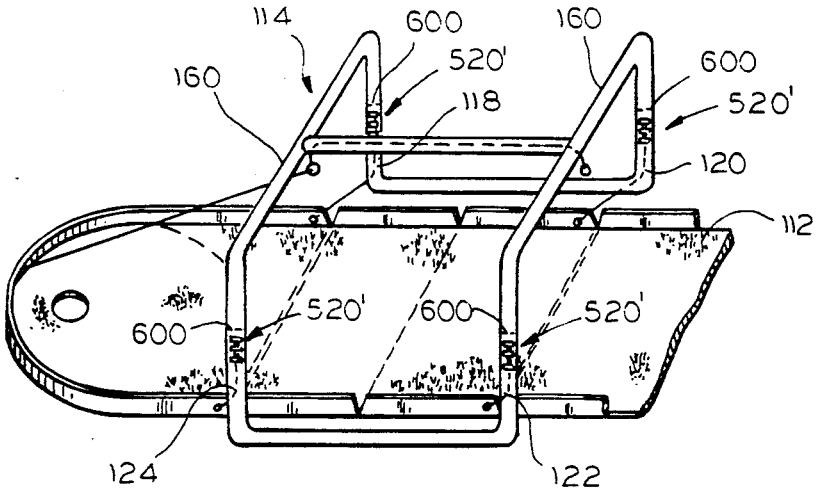
FIG. 14 is a perspective view of a third embodiment of the inventive putting green assembly.
Figure 18:
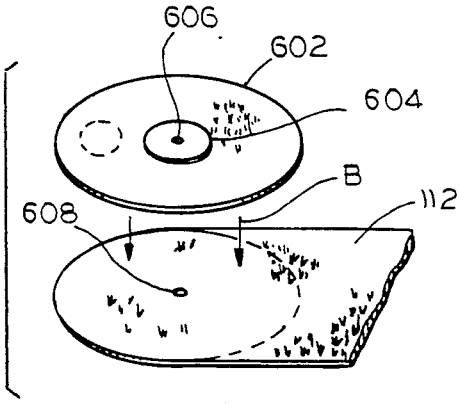
FIG. 18 is a fragmentary perspective view of the rotating hole of the playing mat shown in FIG. 17.

Detent 520 comprises a plurality of recesses 522A, 522B, 522C that are interconnected by channels 524 (see FIG. 12). Channels 524 are more narrow in width than recesses 522. A protuberance or knob 526 (see FIG. 13) connected to the cord members is adapted to slidably move within the narrow channels 524 between the plurality of recesses 522A, 522B, 522C. Knob 526 includes a bulbous head portion 528 and a neck portion 530, as shown in FIG. 18. A small ring 532 attaches to the bottom of neck portion 530. The cord members attach to knob 526 through small ring 532. Once positioned in one of recesses 522A, 522B, 522C, knob 526 is locked into place. FIG. 12 shows knob 526 as it appears positioned in recess 522B of detent 520.

Figure 10:
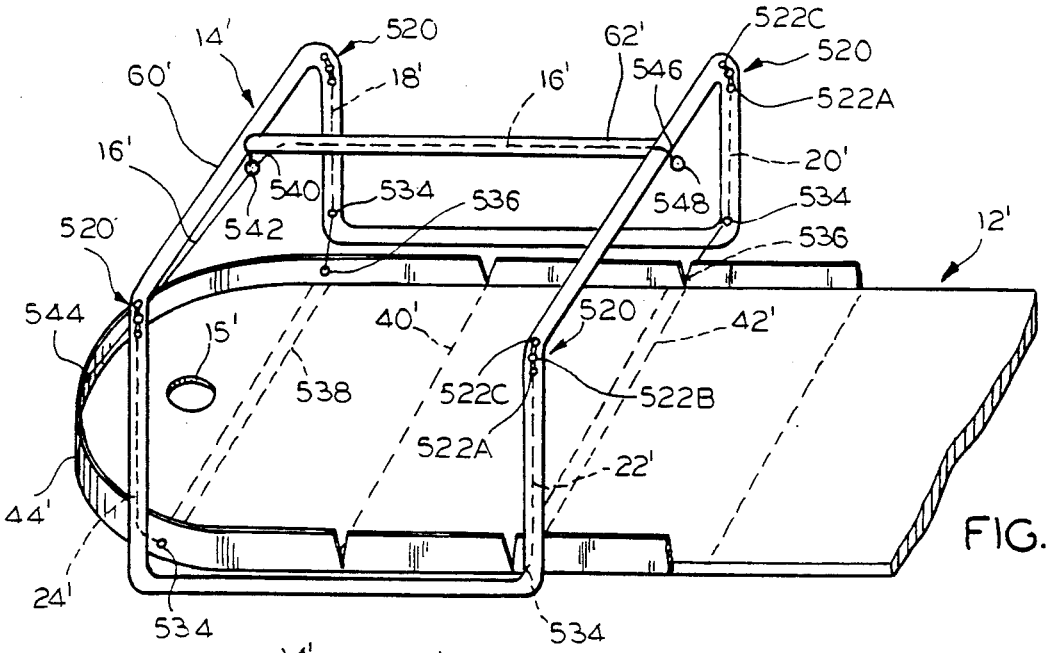
FIG. 10 is a perspective view of a second embodiment of the inventive putting green assembly.
Figure 11:
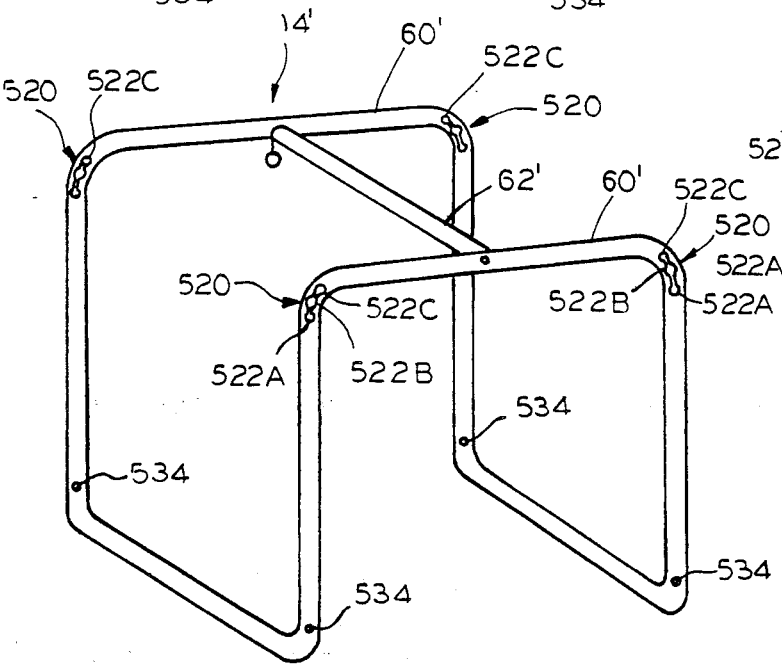
FIG. 11 is a perspective view of the combination slope-elevation and multi-ball retrieval mechanism of the inventive putting green assembly of FIG. 10.

Cord members 18', 20', 22', and 24' each extend downwardly from knob 526 through the interior of pipe 60' until they exit out of pipe 60' through openings 534 and attach to an opening 536 in metal plate strips 42' and 538 (see FIG. 10).

Cord member 16' extends in parallel relationship to and through the interior of pipe 62' until it exits at one end from opening 540, passes through ring 542 and attaches to an opening 544 of ridge 44' of playing mat 12'. Member 16' exits from pipe 62' at the other end through opening 546 and attaches to ring 548.

The elevation and slope adjustment of playing surface 12' of the second embodiment is effectuated by adjusting the length of cord members 18' 20' 22' and 24', which is accomplished by sliding knob 526 through channels 524 into recesses 522B or 522C. For example, the positioning of knob 526 in recess 522A creates a flat topography on playing surface 12'. Then, to create a slope on surface 12', knob 526 is moved to either recess 522B or 522C. The cord members may be adjusted in this manner to create sixteen different slopes for playing surface 12'.

To retrieve a ball from ball cup 15' or from the area surrounding cup 15', ring 548 is pulled towards the player and away from mechanism 14'. As mentioned previously, ring 548 is attached to cord member 16' which is in turn attached to ridge 44' of mat 12'. Thus, when ring 548 is pulled, mat 12' bends along perforation 40' and metal strip 42' and moves upwardly, causing balls to roll away from and out of cup 15' towards the player.

Referring to FIGS. 14–18, a third embodiment is shown for slope elevation and multi-ball retrieval mechanism 114 which is similar in structure to that of the second embodiment shown in FIGS. 10–13, except that detent mechanism 520' is different and playing surface 112 includes a rotatable portion.

Figure 15:
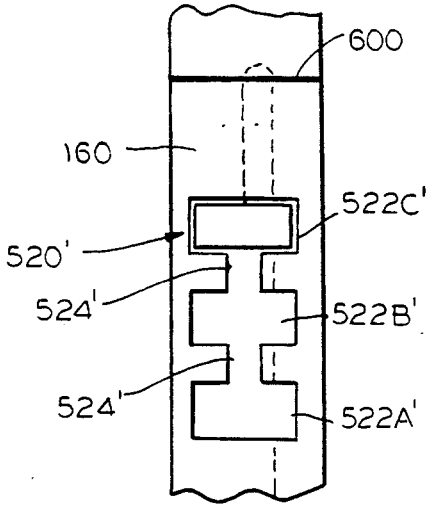
FIG. 15 is a fragmentary side view of the detent mechanism illustrated in FIG. 14.

Detent mechanism 520' comprises a plurality of recesses 522A', 522B', 522C' that are interconnected by channels 524' similar to those illustrated in the second embodiment (see FIG. 15). Likewise, a protuberance or knob 526' (see FIG. 16) is connected to the cord members and slidably moves within channels 524' between the recesses. The cord members attach to knob 526' through an opening 532'. However, the third embodiment further includes a pin 600 which is located above each detent mechanism 520' and which receives cord members 118, 120, 122, 124 which extend upwardly from knob 526', loop around pin 600, and then extend downwardly to playing surface 112. Pin 600 serves to reduce the amount of stress on the upper portion of pipes 160.

Figure 17:
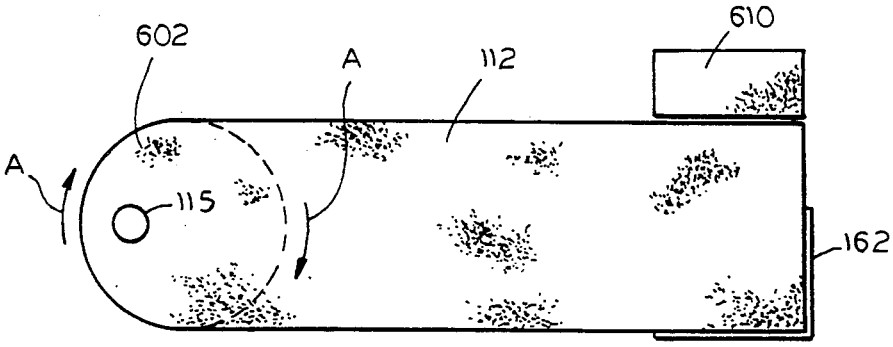
FIG. 17 is a perspective view of the playing surface of the putting green of FIG. 14.

Playing surface 112 may further include a rotatable portion 602 which rotates in a clockwise direction, as indicated by arrows A in FIG. 17. Portion 602 is detachably removable from playing surface 112 and includes a small disc 604 and a pivot receptacle 606 on its bottom side. Portion 602 rotates on surface 112 by inserting or mounting receptacle 606 onto a pivot 608 as indicated by arrows B (see FIG. 18).

Ball cup 115 is located on rotatable portion 602 and assumes a location on surface 112 which is determined by the rotation and position of portion 602.

FIG. 17 further shows an adjustable putting mat 610 and guard rail 612 which may be positioned on one side of mat 10 or the other to compensate for left or right handed players. Both the first and second embodiments may include an adjustable putting mat.

The elevation and slope adjustment of playing surface 112 of the third embodiment is effectuated in the same manner as described in relation to the second embodiment. Likewise, balls are retrieved by the same technique described previously.

A fourth embodiment of a putting green 300 according to the present invention is shown in FIGS. 19–25. This putting green provides automated playing surface elevation, ball return, and scoring and is therefore more suitable for use in commercial or sophisticated applications including, for example, a public game arcade or the home or office of an avid golfer.

Figure 19:
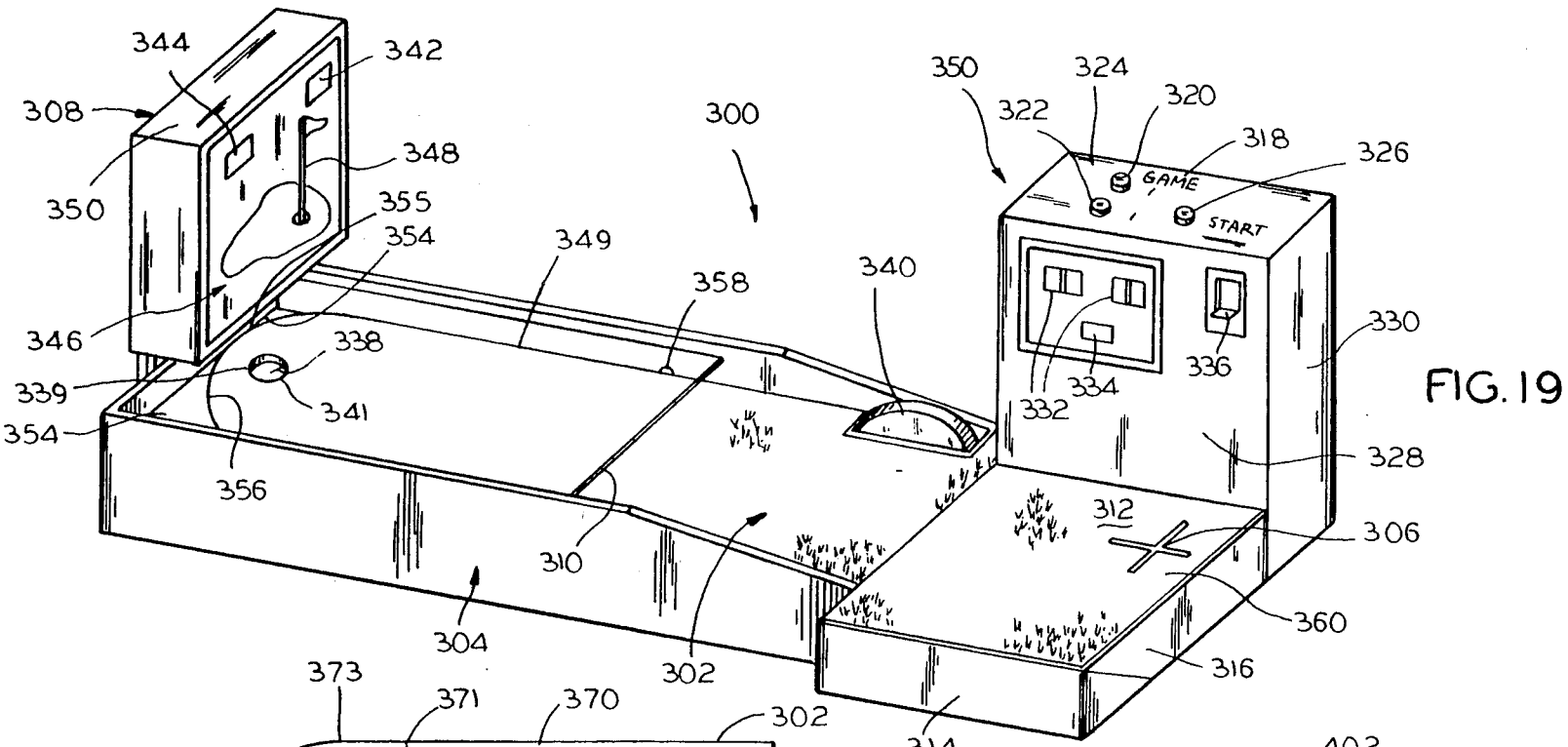
FIG. 19 is a perspective view of a third embodiment of a putting green according to the present invention.

Referring now to FIG. 19, there is shown a perspective view of the automated putting green 300. The putting green has a playing surface 302, a player platform 312, a score and information display 308, and a control station 350 which may optionally include payment receiving unit 332. The playing surface 302 is a substantially rectangular area disposed parallel to a supporting floor surface (not shown) and raised a nominal distance thereover to permit the housing of certain mechanical components of the putting green between the playing surface and the floor. A plurality of wall members 304 support the playing surface 302 on the floor and define an enclosure to protect the mechanical components from tampering and damage due to foreign materials such as dust and rubbish. The wall members 304 extend above the playing surface 302 several inches to prevent golf balls which reach the boundary of the playing surface from dropping onto the floor.

The back of automated putting green 300, beneath control station 350, may include a sloping back wall 309 having a top portion 311. The wall 309 is angled inwardly or forms an acute angle in relation to the bottom of the green 300 at intersection 313 (see FIG. 25). Sloping back wall 309 prevents balls hit with excessive force from bouncing out of the putting green 300.

A transparent semi-rigid window 310, several inches above and substantially parallel to the playing surface 302, extends from the rearmost portion of the playing surface to a position near the front of the playing surface (FIG. 19). The window cooperates with the enclosure wall members 304 to also prevent balls hit with excessive force from bouncing out of the putting green 300, and to prevent players from cheating by manually moving a ball once it has been played. The window 310 is preferably constructed from an appropriate shatter resistant transparent sheet material, such as acrylic or polycarbonate.

The playing surface 302 is preferably covered with a carpet of artificial grass or other appropriate covering to simulate the "green" area found near the "hole" on a golf course. The playing surface 302 is flexible and divided into a number of sections (370 and 372) (FIG. 20) which may be displaced vertically a small distance from their normal (flat) positions to create, in combination, the simulated topography of an actual golf-course green.

Figure 26:
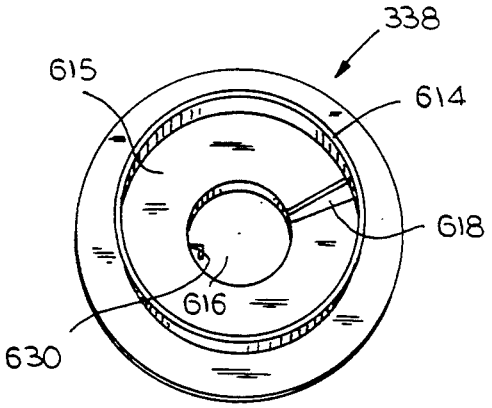
FIG. 26 is a perspective view of the top of the inventive hole assembly.
Figure 28:
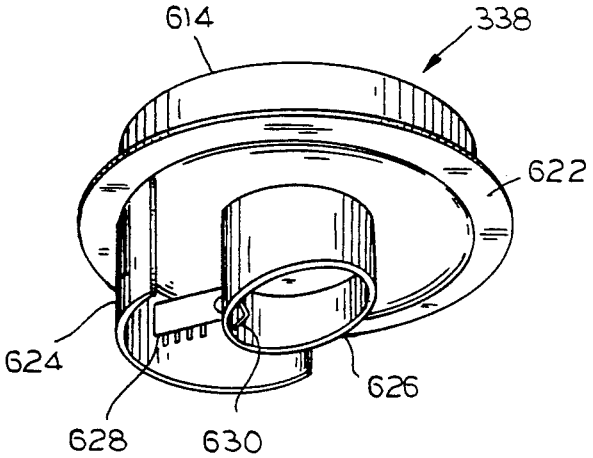
FIG. 28 is a perspective view of the hole assembly of FIG. 26.
Figure 29:
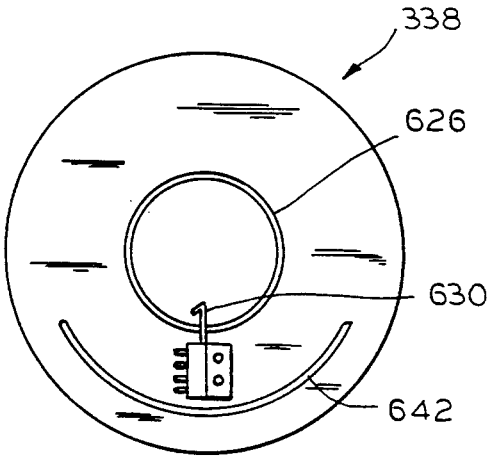
FIG. 29 is a plan view of the bottom of the hole assembly of FIG. 26.

Referring to FIGS. 26, 28–29, the playing surface 302 contains a hole 338 located near its rear extremity to serve as a target for putted balls.

In the preferred embodiment, hole assembly 338 includes a rim 614 which extends circumferentially around a cup 615, which in turn surrounds the perimeter of hole opening 616. The top of rim 614 is level or planar with surrounding playing surface 302. A wedge or stop piece 618 is disposed on cup surface 615 between hole opening 616 and the base of rim 614 and which functions to prevent balls from rolling around on surface 615 and from lodging against rim 614 (particularly when the hole assembly 338 is tilted). The latter function is accomplished by angling the upper surface 620 of wedge piece 618 and creating an incline towards hole opening 616 (see FIG. 27).

FIGS. 28–29 show a disk portion 622 which extends circumferentially around the base of rim 614 and is flush with the underside of playing surface 112. Beneath disk 622 and opposite rim 614, a collar 624 extends arcuately around part of disk 622. Collar 624 and ball hole rim 626 protect an electrical trip piece assembly 628 positioned therebetween. First trip piece 630 extends from trip piece assembly 628 through ball hole rim 626. When a ball falls through, ball rim 626, first trip piece 630 connects with trip piece assembly 630, and electrically signals control unit 420, as discussed in greater detail later.

Referring to FIG. 19, in another embodiment, hole 338 includes an upstanding collar 339 which extends circumferentially around and above about one-half of the perimeter of hole 338'. The collar 339 precludes balls that have initially passed over hole 338' from hitting the enclosure wall members and rolling back into hole 338'. Hole 338' also includes a first trip piece 341 which electrically signals a control unit, as described subsequently.

An automatic ball return mechanism 340 (FIGS. 19, 26–27) is provided near the front of surface 302 to provide, at appropriate times, a new golf ball for a player to use. The return includes a ball kick 632 employing a linear solenoid switch and spring to propel the balls to the surface of the playing mat.

Figure 30:
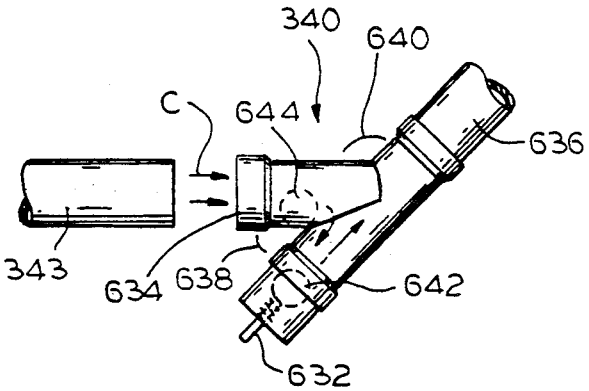
FIG. 30 is a perspective view of the inventive ball return mechanism.
Figure 31:
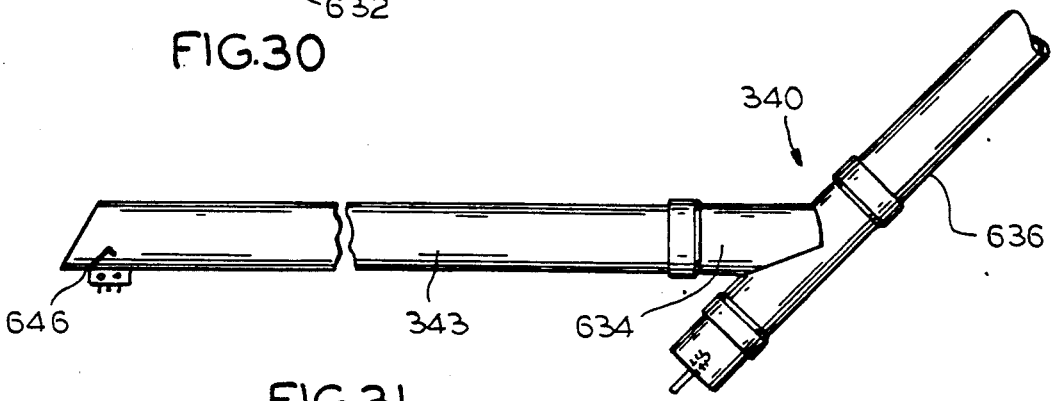
FIG. 31 is another perspective view of the ball return mechanism of FIG. 30.

Ball return mechanism 340 comprises a first pipe 634 which intersects a second pipe 636 and form an acute angle 638 and an obtuse angle 640 which are adjacent each other (see FIGS. 30, 31). First pipe 634 is connected to a gutter channel 343 as indicated by the arrows C. At the beginning of a game, a first ball 642 rests against ball kick 632 in second pipe 636, while second ball 644 is positioned in first pipe 634 and remains there until first ball 642 has been pushed out by ball kick 632. During the game, as soon as second ball 644 passes into gutter channel 343 and triggers second trip piece 646, first ball 642 is pushed out by ball kick 632. Thus, first ball 642 is ejected out of mechanism 340 before second ball 644 enters second pipe 636. If first ball 642 does not eject from mechanism 340, for whatever reasons, ball kick 632 is triggered again to eject the ball 642 a second time before second ball 644 enters second pipe 636. Thus, first and second balls 642, 644, respectively, are usually only adjacent each other in first and second pipes 634, 636, respectively, at the beginning and end of each game. During the game, there is a smooth and constant flow of balls without game delay.

Figure 25:
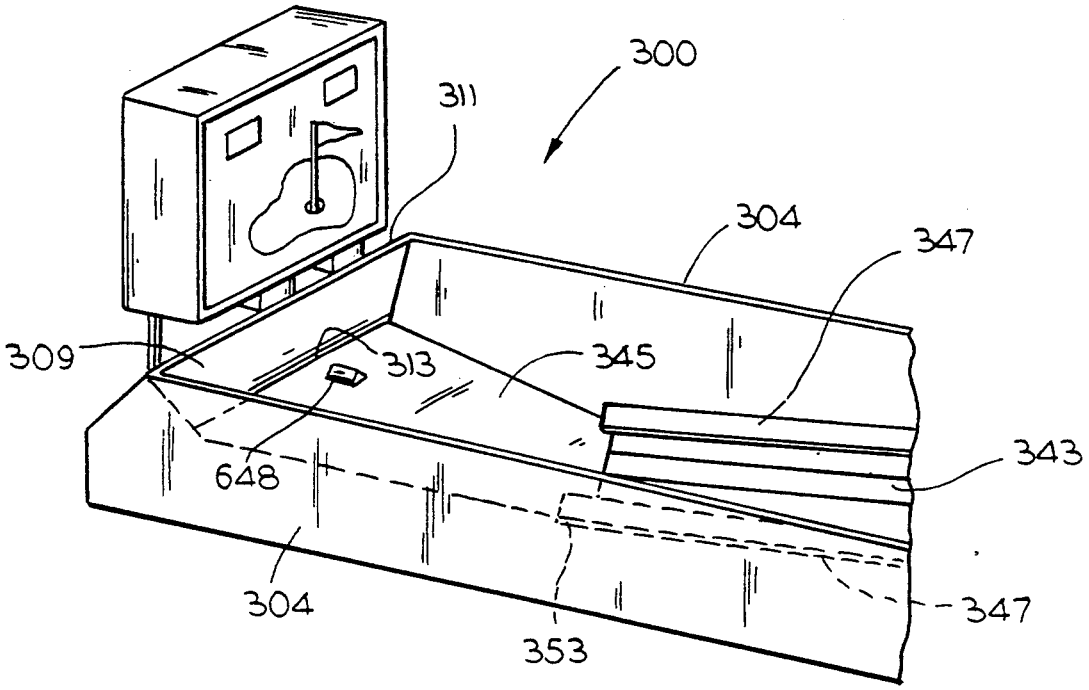
FIG. 25 is a fragmentary perspective view of the putting green assembly of FIG. 20, illustrating the sloped floor panel, gutter channel and side gutters.
Figure 24:
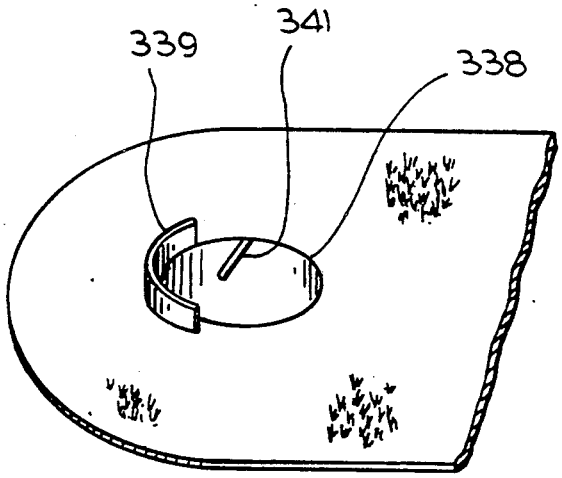
FIG. 24 is a fragmentary perspective view of the ball hole of the invention of FIG. 19.
Figure 27:
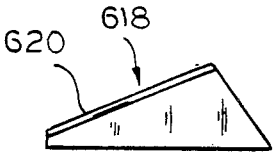
FIG. 27 is a side view of a component of the hole assembly of FIG. 26.

Referring to FIGS. 25–27, the ball return mechanism 340 is connected to gutter channel 343 which in turn is connected to the hole assembly 338 so that golf balls which successfully reach the hole 616 may be recycled for further use. Gutter channel 343 is attached to the end of a sloped floor panel 345. End walls 353 prevent a ball from becoming lost beneath the gutters 343, 347. Panel 345 is sloped such that any ball placed on the surface thereof will roll into gutter channel 343. Gutter channel 343 includes a second trip piece 646 which is located in its interior near the point where channel 343 intersects floor panel 345 (see FIG. 31).

The playing surface 302 preferably has a rounded rear edge 356 (FIG. 19) which, in combination with planar wall members 304, define interstitial ball return openings 354 and back opening 355 into which improperly putted balls may fall. Moreover because surface 302 is not attached on its sides to the side wall, it is also possible for balls to fall beneath the playing surface along the side openings 349 (see FIG. 19). Some balls which overshoot the target hole 338 fall into these openings. Other balls which come to rest on the playing surface 302 without reaching target hole 338 may be urged into these openings 354, 355 via the automatic playing surface elevation means to be discussed subsequently. Balls which enter side opening 349 are returned to the gutter channel 343 by a side gutter 347 (see FIG. 25) which slopes downwardly toward the sloped floor panel 345 and ultimately fall into to the automatic ball return means 340. Likewise, balls which enter openings 354, 355 are returned to gutter channel 343 by floor panel 345 and then are fed to automatic ball return mechanism 340. A pyramid shaped ball guide 648 is located in the rear of floor panel 345 so that balls which enter openings 354, 355 will not get stuck (see FIG. 25). The automated ball return means 340 may include a reservoir capable of retaining a plurality of balls so that more than one ball may be present on the playing surface at a particular time.

The player platform 312 (FIG. 19) is located adjacent the front end of the playing surface 302 and provides a location for the player to stand while making a putt. The top surface 360 of the player platform is preferably flush with the playing surface 302 and is covered with a similar artificial grass carpet so that putted balls will roll smoothly from the player platform top surface 360 to the playing surface 302. A launching area or "tee" 306 is marked on the top surface 360 to indicate the proper ball starting position. The top surface 360 is supported by front and side wall members 316, 314 and by additional supports as needed to accommodate the weight of players.

A control station 350 is provided adjacent the player platform 312 to control the operation of the game. The control station 350 has a front wall 330, side wall 328, and top wall 324. Appropriate control actuators are preferably provided on at least one of these walls to allow the player to select a scoring method or set of game rules and to commence play. For example, push-buttons 320, 322, and 326 are shown on top wall 324, which push-buttons are electrically connected to an appropriate control circuit (FIG. 23) for controlling operation of the mechanical game functions. Suitable legend or instructional material 318 is preferably displayed on top wall 324 to indicate the function of these switches 320, 322, 326.

If the putting green 300 is used in a public place, such as a game arcade, it may be desired to collect payment from the players. Accordingly, a payment receiving unit, including a currency acceptor 336, and coin or token receiving slots 332 is provided adjacent to player platform 312. A coin or token return slot 334 is also provided for rejecting coins which are defective or counterfeit or for providing change should a player overpay. The currency acceptor 336, coin/token receiving slots 332, and coin/token return slot 334 are electrically connected to control unit 420 (FIG. 23) so that balls may be withheld, or other appropriate action may be taken to prevent play by users who have not paid the requisite fee.

Putting green 300 is programmed for various games, number of players, and number of hole selections. Preferably, for example, one to four players may participate by playing nine or eighteen holes and may choose from one of several different competitions and scoring games. Players choose from the various selections by pushing buttons on the payment receiving unit. Regardless of the game chosen, each hole desirably has a different topography which is automatically adjusted. Scoring is determined by the location of the putted ball. Thus, a lower score will be displayed for a hole-in-one whereas, the score is higher for a ball that remains on the playing surface or which rolls off the side or rear of the surface. The player with the lowest score wins.

The score and information display 308 is located above the rear end of the playing surface 302 for providing the current score and other game related information, such as the number of balls left to play, or the player number in a multiple player game. The display 308 includes a front panel 346 disposed substantially perpendicular to the playing surface 302 facing the player platform 312, and is preferably plainly visible to the players and passers by. The front panel 346 includes first and second score displays 342, 344 to indicate the score for each player. The front panel preferably also includes lighted pictorial material 348 for enticing passersby to play the game.

Figure 21:
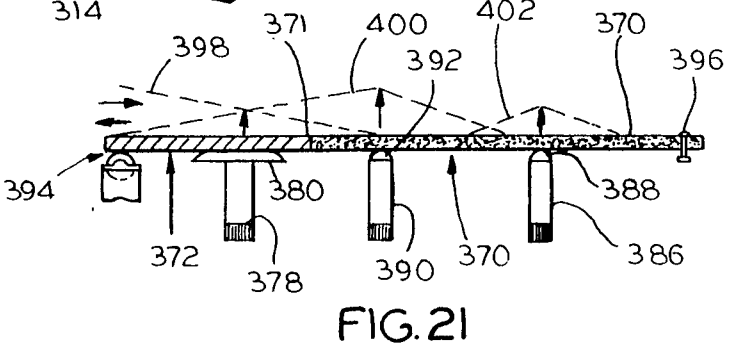
FIG. 21 is a side elevation view of the playing surface and elevation apparatus, as taken along lines 21—21 of FIG. 20.
Figure 20:
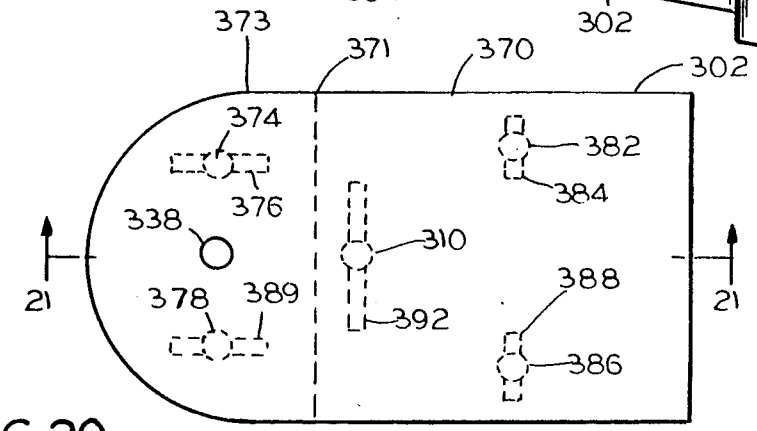
FIG. 20 is a top plan view of the playing surface of the putting green of FIG. 19.

Referring now to FIGS. 20–22, a mechanism is shown for adjusting the elevation of sections of the playing surface 302, thereby modifying its topography. The playing surface 302 is divided into two structural sections: a flexible section 370 and a rigid section 372, which sections are joined at line 371. The flexible section 370 is preferably constructed from a sheet of an appropriate cloth, rubber, or vinyl material. The rigid section 372 is preferably constructed from an appropriate rigid structural material, such as wood, plywood or sheet metal.

Figure 16:
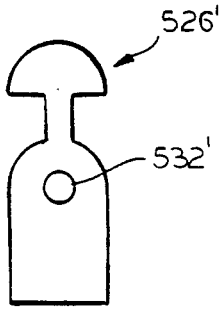
FIG. 16 is a side view of the knob that is a part of the detent mechanism illustrated in FIG. 15.

The flexible section 370 of playing surface 302 is fixedly attached at its front end furthest from hole 338 by tack 396 to the player platform 312 so that it may not move either vertically or horizontally. The rigid section 372 is supported at its rear end by a roller 394, but is not attached to the roller, so that section 372 may move both horizontally (i.e. longitudinally) and vertically. Roller 394 is adapted to swivel from side to side so that rigid section 372 has freedom of movement. A set of five elevation supports 376, 380, 384, 388, 392 are disposed under the playing surface 302 in approximate corner positions and an approximate center position thereof for supporting and elevating an overlying segment of the playing surface 302. Supports 376, 380, 384, 388 and 392 rest on a set of five playing surface segment elevation actuators 374, 378, 382, 386, and 390, respectively, which control the vertical positions of the supports. The actuators 374, 378, 382, 386 and 390 are preferably electrically controlled and operated and may each independently assume a coplanar position as shown in FIG. 16 or an elevated position. When in the elevated positions, each actuator desirably raises its respective support a distance of approximately 2–4 inches.

Since the playing surface 302 rests on and is supported by the supports 376, 380, 384, 388 and 392, elevating the supports will elevate a surrounding segment of the playing surface. This is shown in FIG. 21 where dotted lines 398, 400, and 402 indicate the profile of the playing surface 302 when supports 380, 392, and 388 are respectively elevated. Since supports 384, 388, and 392 are disposed under the flexible section 370 of playing surface 302, a convex hill is formed about these supports when they are elevated. In contrast, supports 376 and 380 are disposed under the rigid section 372 of playing surface 302. Since the rear end of section 372 is free to move vertically, rigid section 372 assume an angular incline as shown by line 398 when these supports 376, 380 are raised.

The supports 376, 380, 384, 388 and 392 are substantially bar shaped and have a curved upper surface so that the hills formed thereby are relatively gentle. In addition, the curved upper surface of the supports prevents perforation or other damage to the playing surface 302.

Because each actuator 374, 378, 382, 386, and 390 may be independently controlled, different positions and combinations of actuators create a large number of potential playing surface topographies, thereby providing variety and challenge to the players. FIG. 22 lists a number of combinations of actuator positions which produce useful playing surface topographies. Each column represents the position of one of the actuators 374, 378, 382, 386, and 390 respectively. Each row represents a particular combination of actuator positions. An "E" in the table indicates that the corresponding actuator is elevated, and an "N" in the table indicated that the corresponding actuator is in its lowered or "normal" position. Thus, in row 11, actuators 374 and 386 are in their elevated positions, and actuators 378, 382, and 390 are in their normal positions. This combination would result in an incline in the rear right corner of the playing field 302 corresponding to actuator 374, and a hill in the front left corner of the playing field 388.

Combination number 19 of FIG. 22, representing the case where only actuator 390 is elevated, is of particular interest. In this position, most of the balls which have come to rest on the playing surface 302 will roll toward the rear of the playing surface and fall into ball return openings 354, 355 for collection. Thus, most of the balls on the playing surface 302 may be collected automatically by setting the playing surface to conform to, for example, row 19 of FIG. 22.

Ball location detector 358 (FIG. 19) (discussed in greater detail later) senses that a ball has passed a predetermined location on the playing surface and further senses that either the ball has not fallen into hole 338' or 616 and triggered the first trip piece 341 or 616, respectively, or the ball has not rolled toward and fallen through sides 349 or rear openings 354, 355 to trigger second trip piece 646. If neither the first nor second trip piece 341 or 646, respectively, is triggered within a preselected time period (e.g. eight seconds) from the time that the ball passes detector 358, then the ball must still be on the playing surface at rest. The detector 358 signals the control unit 420 to activate the actuators, thereby elevating the mat so that one or more different parts of the mat are raised. This movement causes the ball to roll off of the playing surface via the side or rear openings and into gutter channel 343. As soon as the ball enters gutter channel 343, second trip piece 646 is triggered which immediately stops the actuators. Should the ball inadvertently fall into hole opening 338 or 616 during the actuator sweeping motion, control unit 420 will not signal a "hole-in-one".

Figure 23:
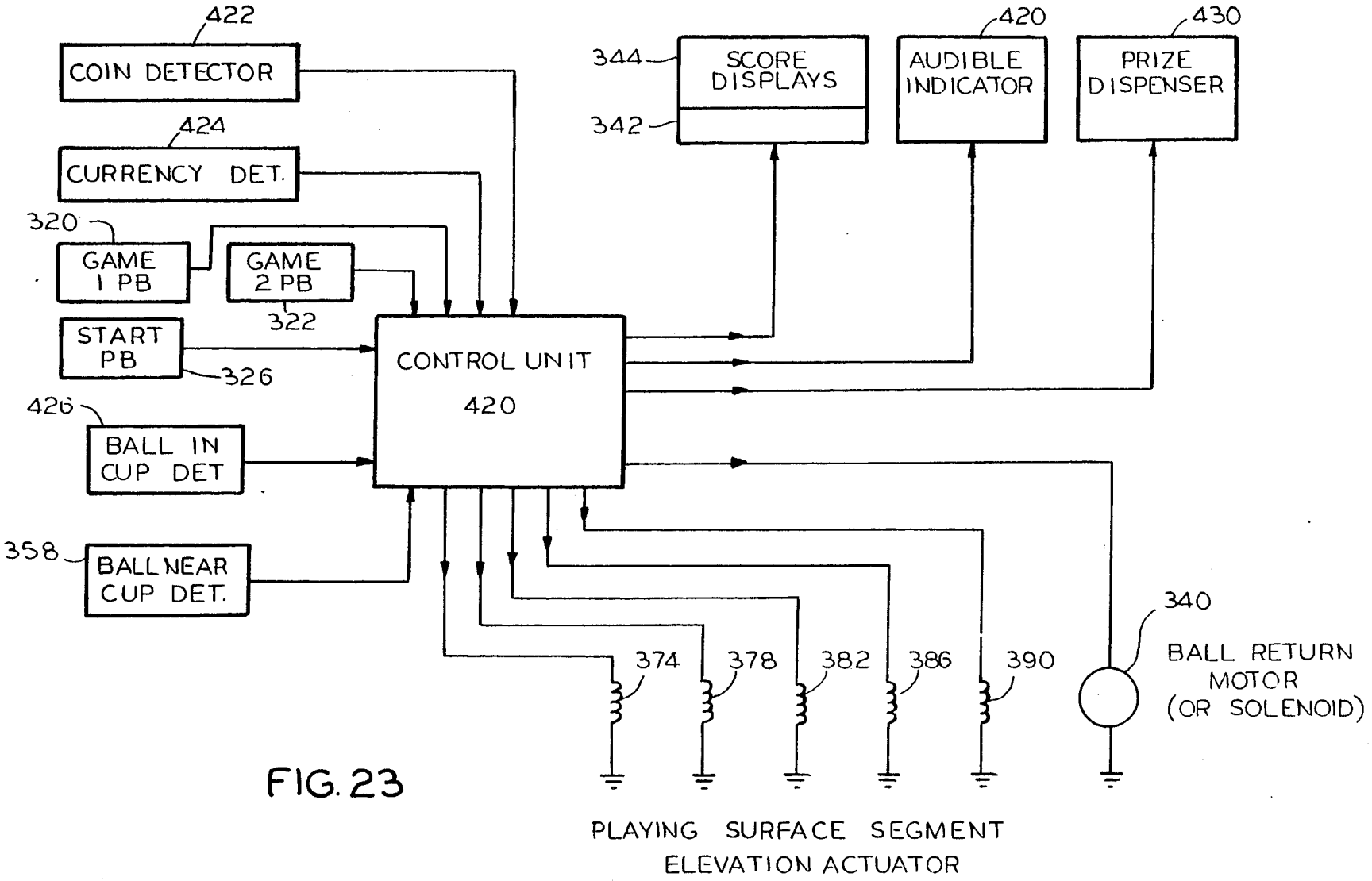
FIG. 23 is a block diagram of a control arrangement for the fourth embodiment for the putting green.

FIG. 23 shows a block diagram of a suitable control arrangement for the automated putting green 300 of FIGS. 14–20. A suitable control unit 420 is provided to sense the status of various components of the automated putting green 300, to control the score and information display 308, and to control the playing surface topography apparatus. Control unit 420 is preferably a microprocessor-based controller, such as a Motorola 68705U3 microcomputer, but any suitable control means, such as discrete electronic logic, could be used. Such controllers are well known in the electronic arts. Control unit 420 may be located in score and information display 308 or control station 350, or another location in putting green 300 as appropriate.

In an arcade environment, control unit 420 preferably receives a status signal from a coin detector 422 and a currency detector 424 so that it may determine whether the players have paid a requisite fee to commence a game. Control unit 420 also receives a status signal from each of push-buttons 320, 322, and 326, permitting players to select first and second preprogrammed "games" (i.e. particular topographies and scoring rules) and to request the commencement of a new game.

In addition, control unit 420 preferably receives signals from ball location detectors 358 (FIG. 19) 341, 646 (FIGS. 19, 26, 28–29, 31) which respectively indicate that a ball has passed a predetermined location on the playing surface or that a ball has entered target hole 338 or 616. Detectors 358, 341 and 646 may be implemented using any appropriate sensor. Detector 358 is preferably an optical detector (such as a photocell) which senses when a ball has interrupted a beam of light from an opposing emitter (not shown). Detectors 341 and 646 are preferably each a trip piece which electrically signal a control switch. Control unit 420 may use the information received from these detectors 358, 341, 646 for ball counting purposes, for scoring, and to determine when excess balls on the playing surface should be collected. While two detector positions are described in this embodiment, additional detector positions may be desirable for additional scoring or control purposes.

For example, control unit 420 may control first and second score displays 342, 344 for first and second players respectively. Score displays 342, 344 may be any appropriate numeric or alpha-numeric displays, including mechanical, light emitting diode, neon, fluorescent, liquid-crystal or other displays capable of being controlled by control unit 420. Control unit 420 preferably also controls an audible indicator 428, such as a bell or speaker, for providing appropriate sounds to accompany scoring events or to attract passers by. In addition, control unit 420 may also control a dispenser 430 for emitting prize tokens or other awards for players who achieve a score above or below a predetermined threshold.

Control unit 420 also controls playing surface segment elevation actuators 374, 378, 382, 386, and 390 . Actuators 374, 378, 382, 386, and 390 may include solenoids, motors, hydraulic components, or other appropriate electromechanical devices capable of being controlled by control unit 420 and capable of moving of respective segments of playing surface 302. In addition, control unit 420 controls the operation of automatic ball return mechanism 340, described earlier.

Control unit 420 is preferably adapted to selectably control putting green 300 according to one or more predefined "games" or combinations of particular topographies and scoring rules. For example, a first "game" might call for the putting green to deliver nine balls, one at a time, with the playing surface conforming to a different topography for each ball (i.e., for each ball, a different one of the topographies shown in FIG. 13 would be selected). The score would be calculated by counting the number of balls which reach the target hole 338. A second "game" might call for the putting green to deliver 18 balls, one at a time, selecting a topography for each ball. The final score would be calculated by assigning for each hole a score depending on whether the ball reached the hole 338, came near the hole 338, or fell down the ball return openings 354, and averaging all hole scores.

It should be recognized that, while the invention has been described in relation to three embodiments, those skilled in the art may develop a wide variation of structural details without departing from the principles of the invention. Therefore, the appended claims are to be construed to cover all equivalents falling within the true scope and spirit of the invention.

I claim:

1. A practice putting green assembly, said assembly comprising a playing mat having a putting end, a ball cup in said mat, and means for adjusting a topography of said green, said adjusting means being above said playing mat and including a support structure having an interior channel, said adjusting means further including a plurality of elongated members extending at least partially through said interior channel in said support structure for raising and lowering parts of said playing mat.

2. The practice putting green assembly of claim 1 wherein said adjusting means can selectively elevate a section of said playing mat adjacent said ball cup.

3. The putting green assembly of claim 1 wherein said elongated members selectively elevate parts of said playing mat to create a plurality of inclines therein.

4. The practice putting green assembly of claim 1 wherein a plurality of balls can be returned to said putting end by pulling one of said elongated members and causing said playing mat to incline.

5. The practice putting green assembly of claim 1 wherein at least one of said elongated members extends outside said interior channel and is attached to an external surface of said support structure.

6. The practice putting green assembly of claim 1 including protruding means on at least one of said elongated members and wherein said support structure includes at least one detent means for engaging said protruding means.

7. The practice putting green assembly of claim 1 wherein said ball cup includes an inclined bottom.

8. The putting green assembly of claim 7 wherein said inclined bottom is inclined downwardly away from said putting end.

9. The putting green assembly of claim 7 wherein said ball cup further includes a rim, said rim extending above and partially around a part of the cup furthest from said putting end of said assembly.

10. A putting green assembly comprising:

a playing surface having a putting end, a ball cup end, and a ball cup therein;

means for adjusting a topography of said playing surface, said adjusting means being over said playing mat and including a support structure and a plurality of elongated members connected to said support structure and to said playing surface for selectively raising or lowering sections of said playing surface to create various selected putting topographies, one of said elongated members for inclining said entire ball cup end upwardly sufficiently to cause one or more balls thereon to return toward said putting end, and whereby release of said latter elongated member reclines said ball cup end to a preselected putting topography.

* * * * *